US007002066B2

(12) United States Patent
Yu

(10) Patent No.: US 7,002,066 B2
(45) Date of Patent: Feb. 21, 2006

(54) MUSICAL INSTRUMENT STAND

(76) Inventor: Ming-Ti Yu, 122-5, Jun Laio Rd., Feng Yuan, Taichung Hsien (TW)

( * ) Notice: Subject to any disclaimer, the term of this patent is extended or adjusted under 35 U.S.C. 154(b) by 63 days.

(21) Appl. No.: 10/764,301

(22) Filed: Jan. 20, 2004

(65) Prior Publication Data

US 2005/0155481 A1 Jul. 21, 2005

(51) Int. Cl.
*G10D 3/00* (2006.01)

(52) U.S. Cl. ..... 84/327

(58) Field of Classification Search ..... 84/327, 84/421, 329; 248/443

See application file for complete search history.

(56) References Cited

U.S. PATENT DOCUMENTS

2004/0237755 A1 * 12/2004 Laio
2005/0016354 A1 * 1/2005 Kent

* cited by examiner

*Primary Examiner*—Kimberly Lockett
(74) *Attorney, Agent, or Firm*—Alan D. Kamrath; Nikolai & Mersereau, P.A.

(57) ABSTRACT

A musical instrument stand has a base frame having a joint connected to three leg rods and a main pipe, a main tube engaging with the main pipe, a socket disposed on the main pipe, a connector disposed on a top end of the main tube, a bracket support device engaging with the socket, and a fixed brace device engaging with the connector. A fastening bolt fastens the main pipe and the main tube. The connector has a lower tube and a transverse pipe connected to the lower tube. The transverse pipe has an enlarged opening, an L-shaped end notch communicating with the enlarged opening, a through hole communicating with the enlarged opening, an inner recess formed in an inner wall of the transverse pipe, and an inner chamber communicating with the inner recess and the through hole.

5 Claims, 15 Drawing Sheets

MUSICAL INSTRUMENT STAND

FIELD OF THE INVENTION

The present invention relates to a musical instrument stand, and more particularly to a musical instrument stand which is easily assembled and detached.

BACKGROUND OF THE INVENTION

Referring to FIG. 16, a conventional guitar stand has a four-way base frame 93, a socket 95 disposed on the four-way base frame 93, a generally Y-shaped bracket 96 engaging with the socket 95, a main rod 94 engaging with the four-way base frame 93, and a generally U-shaped brace 97 disposed on a top end of the main rod 94. It is difficult to pack the conventional guitar stand. It is difficult to carry the conventional guitar stand also. Furthermore, the conventional guitar stand cannot replace other musical instrument stand to hold other musical instruments.

SUMMARY OF THE INVENTION

An object of the present invention is to provide a musical instrument stand which is easily assembled by a user.

Another object of the present invention is to provide a musical instrument stand which is easily detached by a user.

Another object of the present invention is to provide a musical instrument stand which holds one of various musical instruments.

Accordingly, a musical instrument stand comprises a base frame, a main tube, a socket, and a connector. The base frame has a joint, a first leg rod, a second leg rod, a third leg rod, a main pipe, and the joint connected to the first leg rod, the second leg rod, the third leg rod, and the main pipe. The main tube engages with the main pipe. The main tube has a plurality of oblong grooves to receive a fastening bolt. The socket is disposed on the main pipe. The connector is disposed on a top end of the main tube. An inner tube is inserted in the socket. The inner tube has an inner groove. A support device engages with the socket. A brace device engages with the connector. The fastening bolt fastens the main pipe and the main tube.

DETAILED DESCRIPTION OF THE INVENTION

Figure 1:
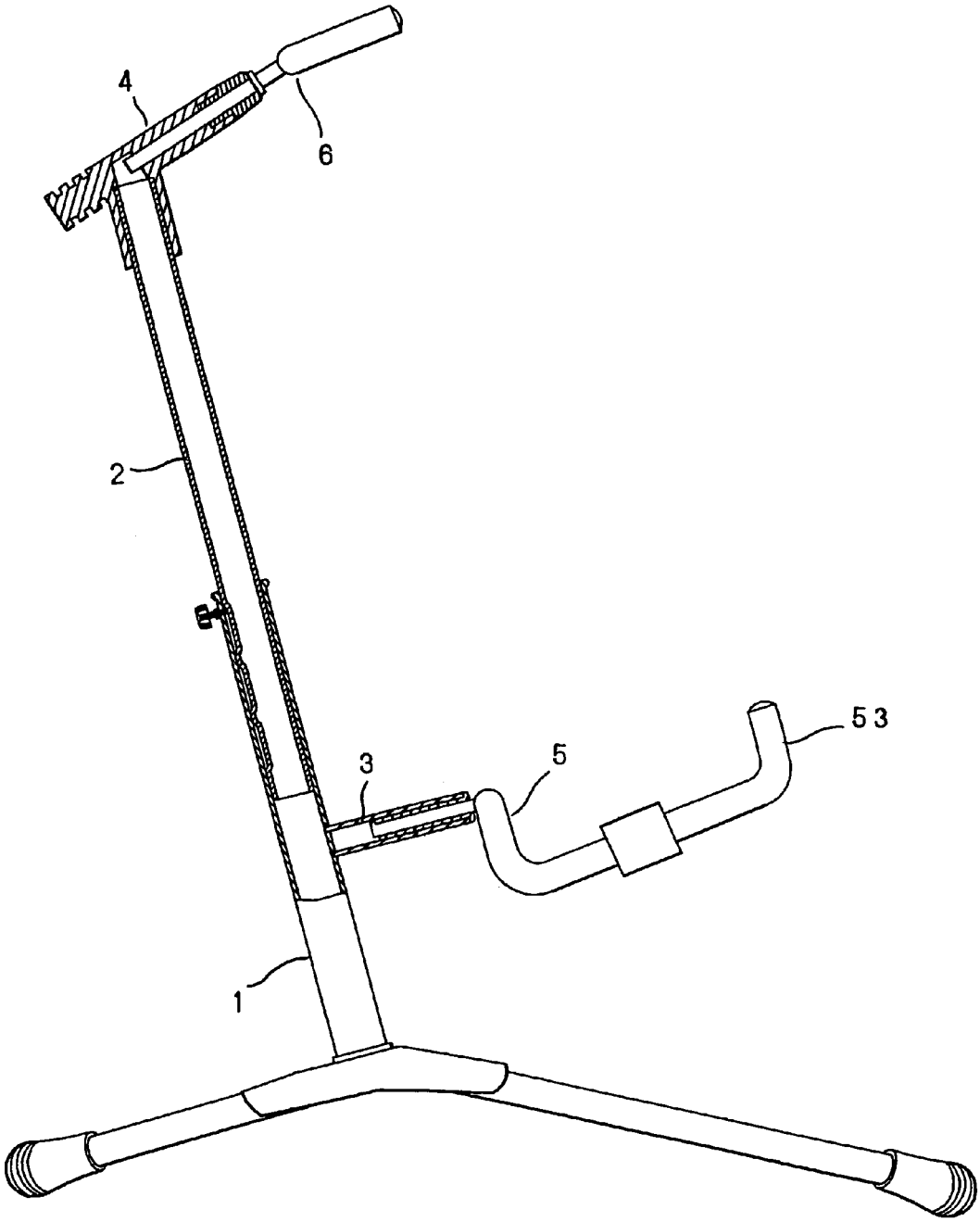
FIG. 1 is a sectional assembly view of a musical instrument stand with a bracket support device of a preferred embodiment in accordance with the present invention.
Figure 2:
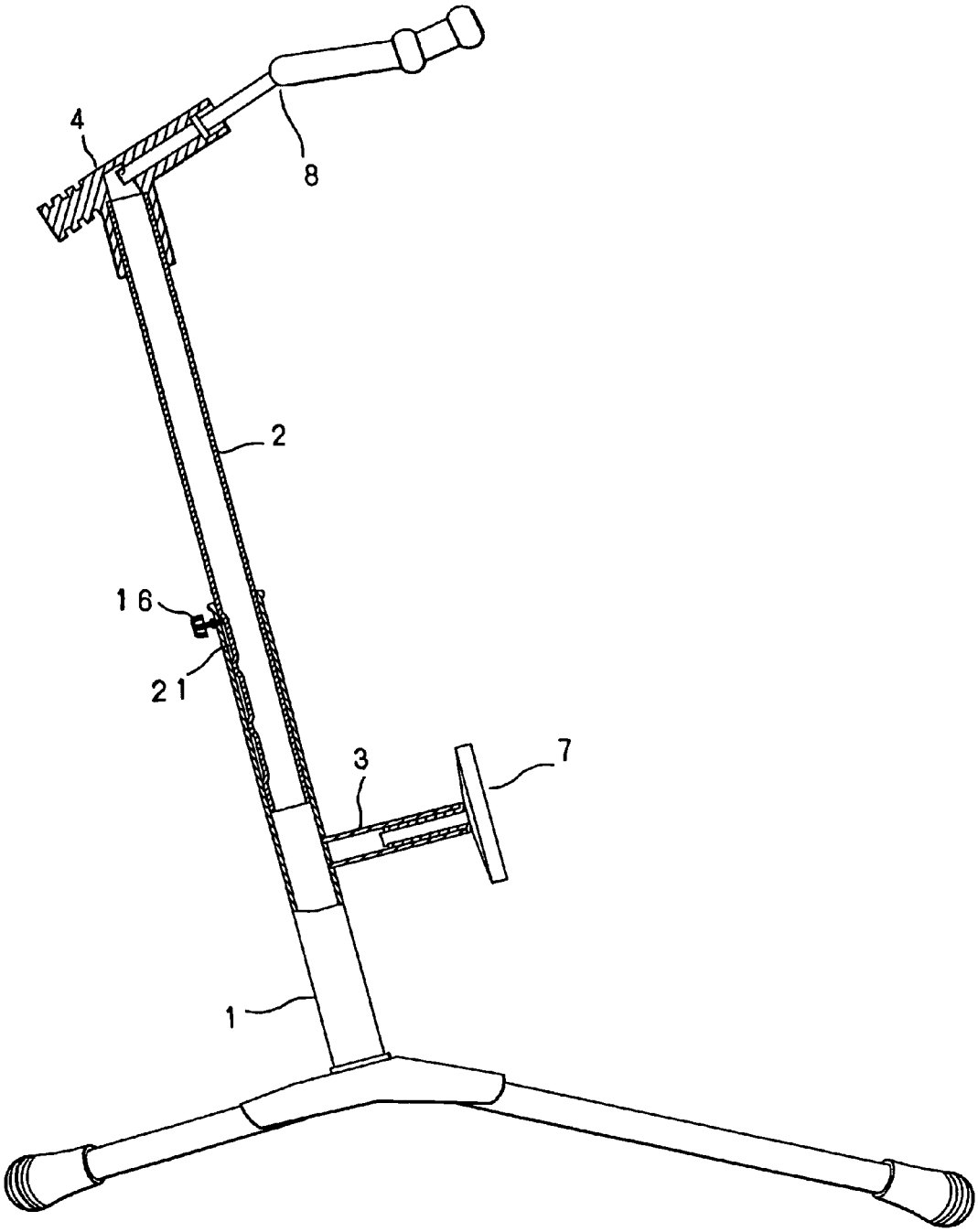
FIG. 2 is a sectional assembly view of a musical instrument stand with a first padding support device of a preferred embodiment in accordance with the present invention.
Figure 3:
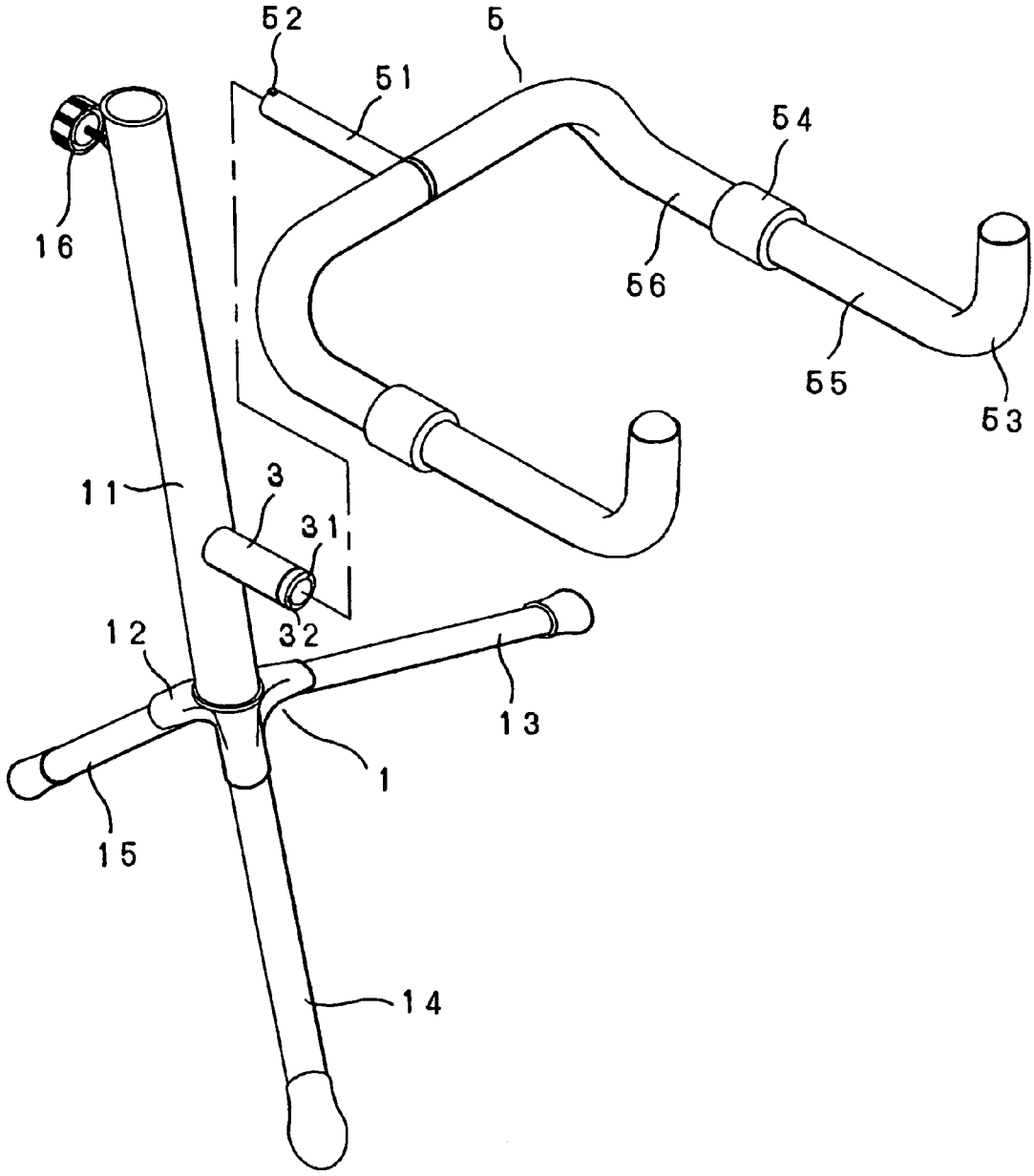
FIG. 3 is a perspective exploded view of a base frame and a bracket support device of a preferred embodiment in accordance with the present invention.

Referring to FIGS. 1 to 3, a musical instrument stand comprises a base frame 1, a main tube 2, a socket 3, and a generally T-shaped connector 4.

The base frame 1 has a joint 12, a first leg rod 13, a second leg rod 14, a third leg rod 15, a main pipe 11, and the joint 12 connected to the first leg rod 13, the second leg rod 14, the third leg rod 15, and the main pipe 11. A user (not shown in the figures) will fold the first leg rod 13, the second leg rod 14 and the third leg rod 15 from the joint 12 in order to store the musical instrument stand. Since the joint 12 is connected to the first leg rod 13, the second leg rod 14 and the third leg rod 15 pivotally, the first leg rod 13, the second leg rod 14 and the third leg rod 15 will be extended or folded by the user.

The main tube 2 engages with the main pipe 11. The main tube 2 has a plurality of oblong grooves 21 to receive a fastening bolt 16.

The socket 3 is disposed on the main pipe 11.

The generally T-shaped connector 4 is disposed on a top end of the main tube 2.

An inner tube 31 is inserted in the socket 3. The inner tube 31 has an inner groove 32.

The fastening bolt 16 fastens the main pipe 11 and the main tube 2. Since one of the oblong grooves 21 of the main tube 2 receives the fastening bolt 16, the main tube 2 will not fall off suddenly while the fastening bolt 16 is loosened. Therefore, a musical instrument (not shown in the figures) which is suspended on the musical instrument stand will not be damaged. It is an advantage of the present invention.

Referring to FIGS. 1 and 3, a bracket support device 5 has a generally U-shaped rod 56, a shaft 51 connected to the generally U-shaped rod 56, the shaft 51 having an end bolck 52, two extending arm portions 55 extending from two sides of the generally U-shaped rod 56, each of the extending arm portions 55 having an end hook 53, and two pad collars 54.

Each of the pad collars 54 surrounds the corresponding extending arm portion 55.

The shaft 51 is inserted through the inner tube 31. The end block 52 is moved along the inner groove 32 of the inner tube 31.

Figure 4:
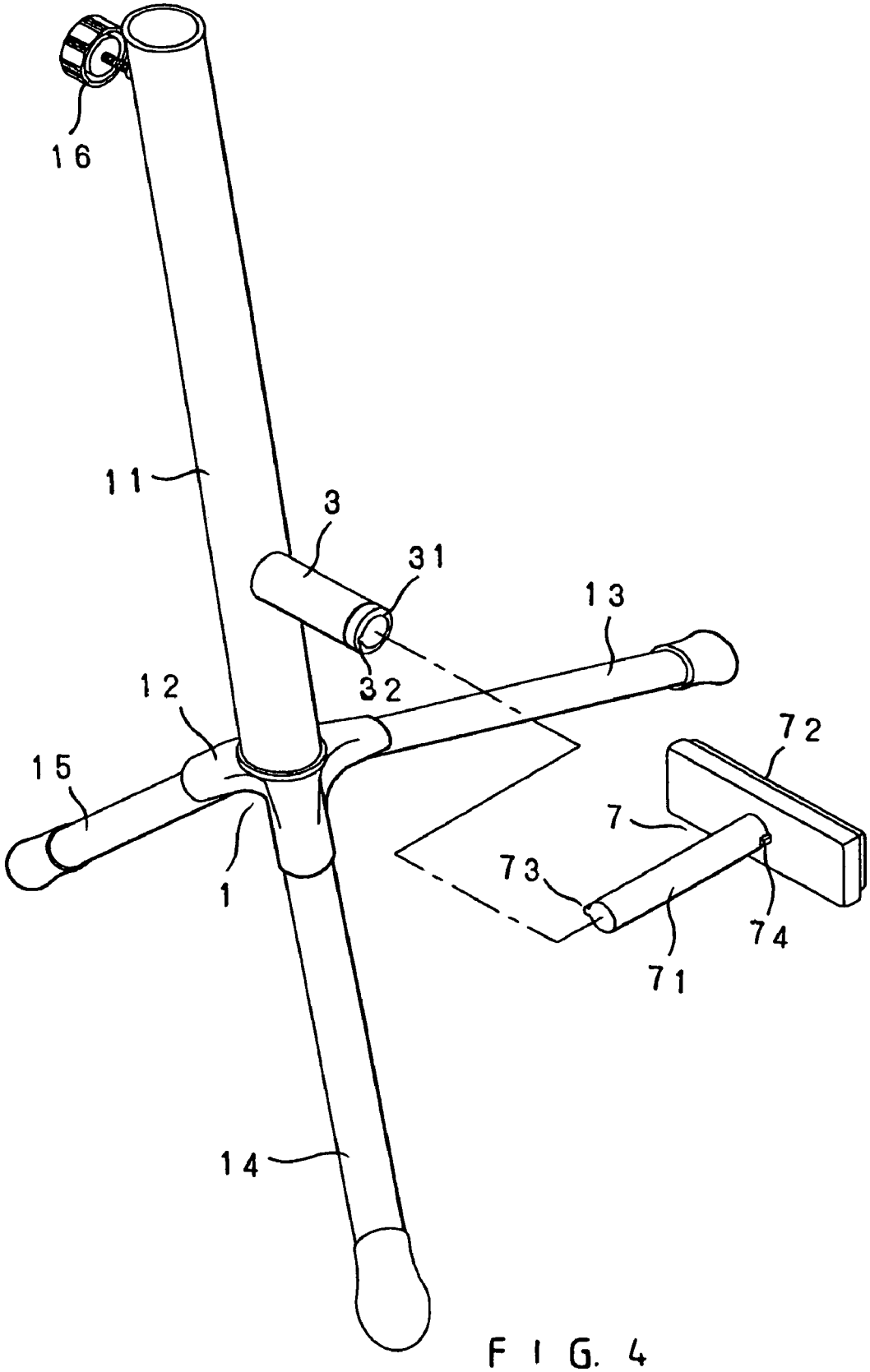
FIG. 4 is a perspective exploded view of a base frame and a first padding support device of a preferred embodiment in accordance with the present invention.
Figure 6:
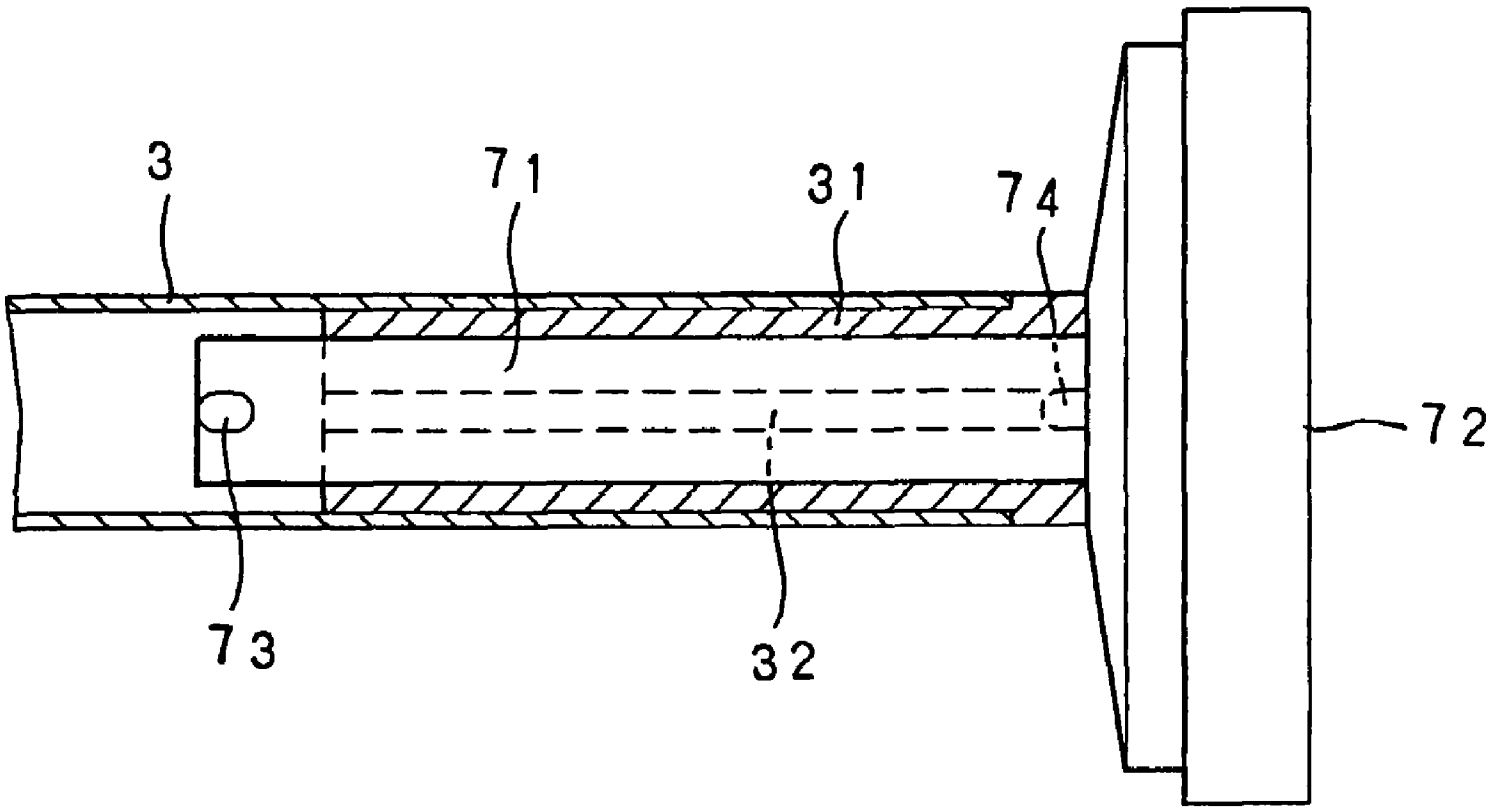
FIG. 6 is a sectional assembly view of a socket and a first padding support device of a preferred embodiment in accordance with the present invention.

Referring to FIGS. 4 and 6, a first padding support device 7 has a first pad 72 and a first post 71 connected to the first pad 72.

The first post 71 has a first distal bolck 73 and a first positioning protrusion 74.

The first post 71 is inserted through the inner tube 31. The first distal block 73 is moved along the inner groove 32 of the inner tube 31.

Figure 5:
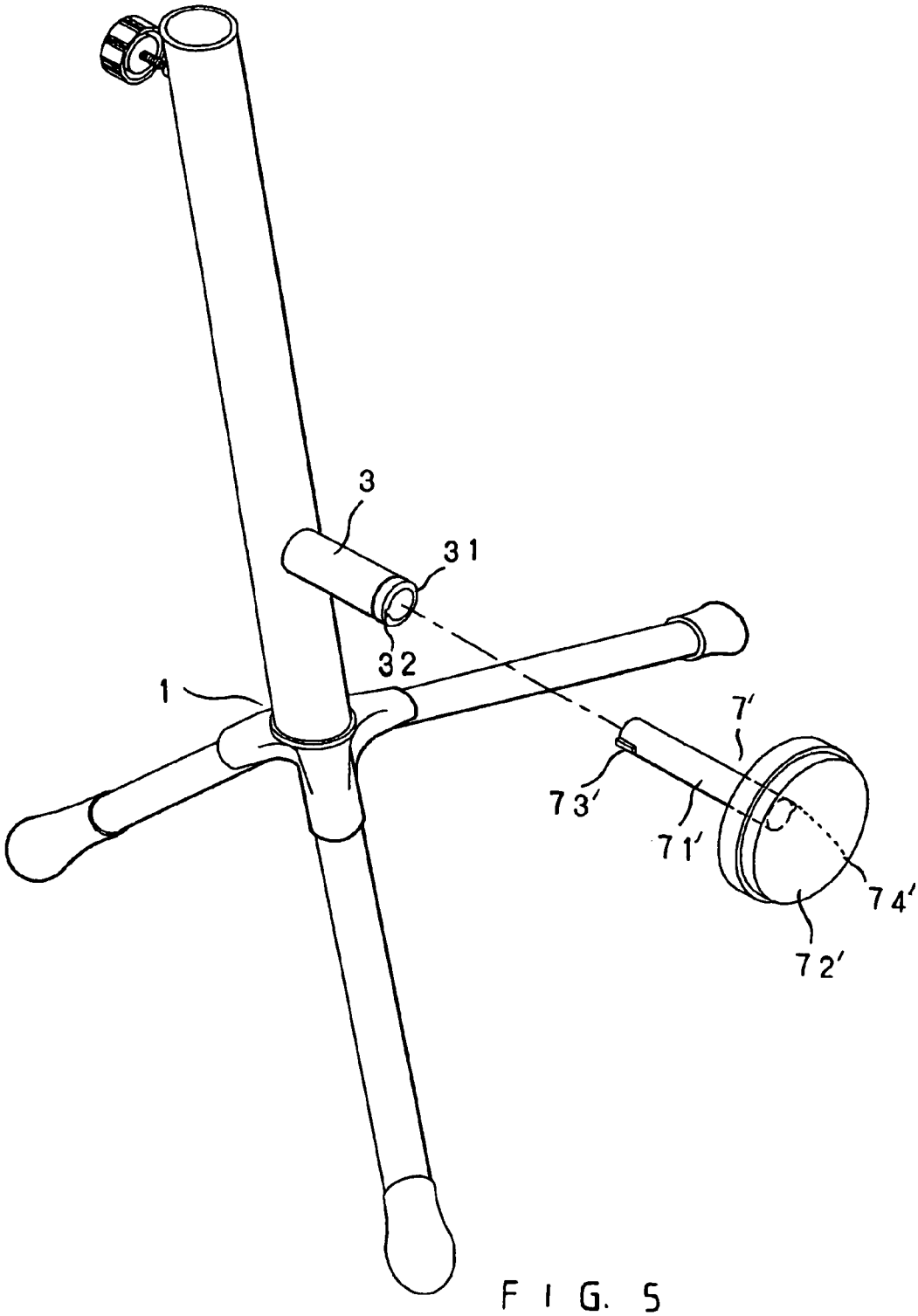
FIG. 5 is a perspective exploded view of a base frame and a second padding support device of a preferred embodiment in accordance with the present invention.

Referring to FIG. 5, a second padding support device 7' has a second pad 72' and a second post 71' connected to the second pad 72'.

The second post 71' has a second distal bolck 73' and a second positioning protrusion 74'.

The second post 71' is inserted through the inner tube 31. The second distal block 73' is moved along the inner groove 32 of the inner tube 31.

Figure 7:
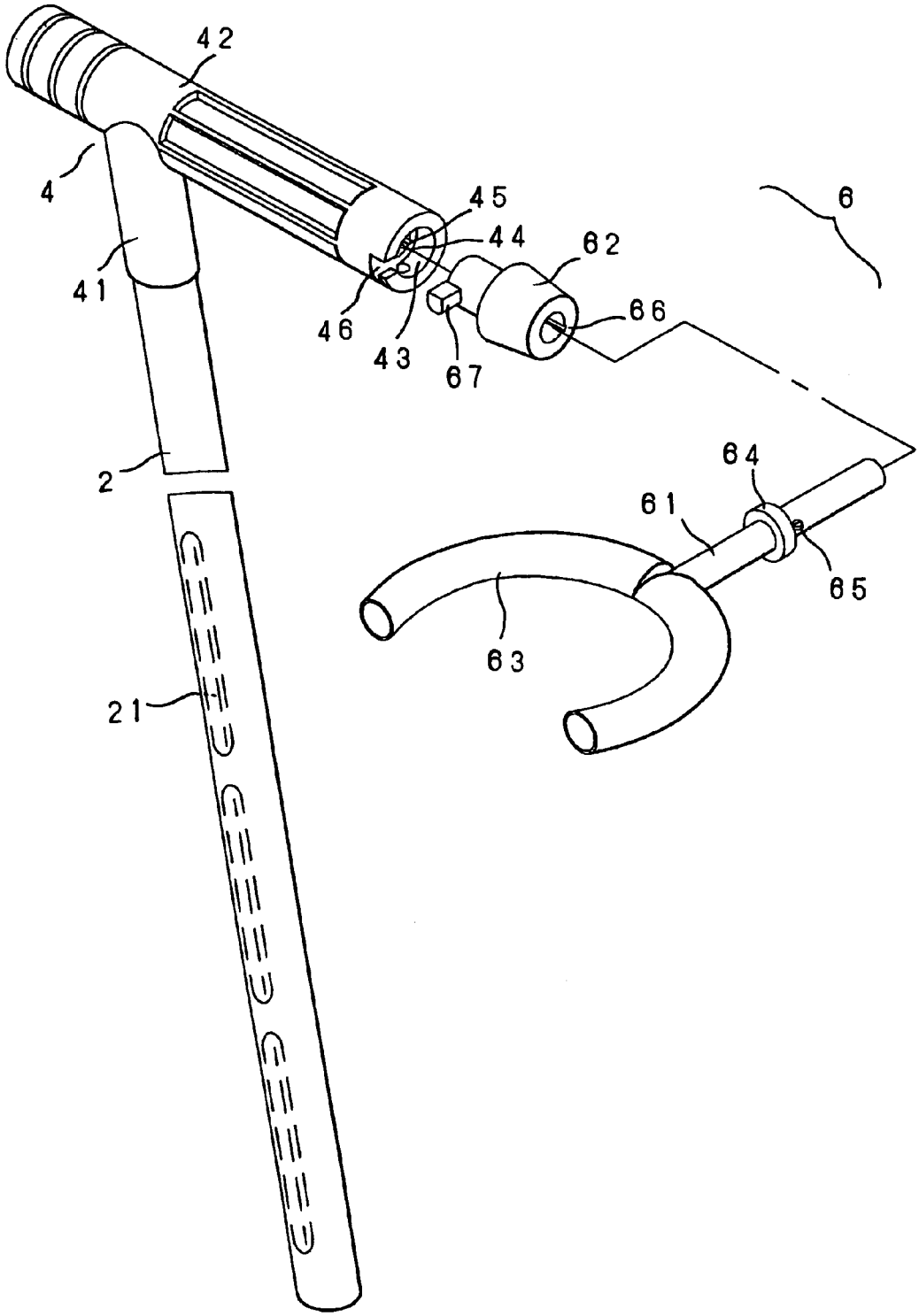
FIG. 7 is a perspective exploded view of a connector and a fixed brace device of a preferred embodiment in accordance with the present invention.
Figure 9:
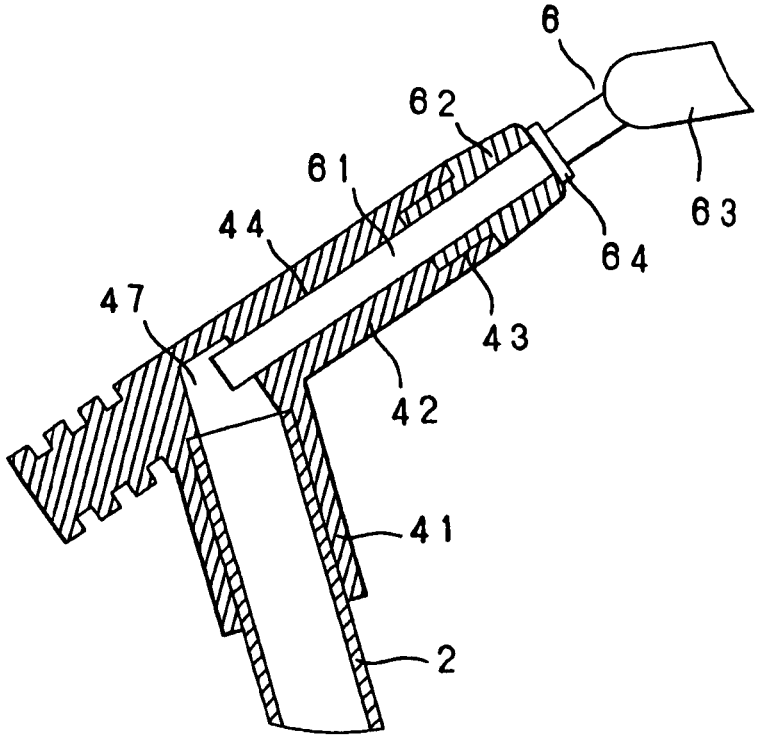
FIG. 9 is a sectional assembly view of a connector and a fixed brace device of a preferred embodiment in accordance with the present invention.

Referring to FIGS. 7 and 9, the generally T-shaped connector 4 has a lower tube 41 and a transverse pipe 42 connected to the lower tube 41.

The lower tube 41 engages with the main tube 2.

The transverse pipe 42 has an enlarged opening 43, an L-shaped end notch 46 communicating with the enlarged opening 43, a through hole 44 communicating with the enlarged opening 43, an inner recess 45 formed in an inner wall of the transverse pipe 42, and an inner chamber 47 communicating with the inner recess 45 and the through hole 44.

Referring to FIGS. 7, 9, 11 and 12, a fixed brace device 6 has a U-shaped tube 63, a pillar 61 connected to the U-shaped tube 63, and a hollow plug 62 to receive the pillar 61.

The hollow plug 62 has an internal recess 66.

A positioning block 67 is disposed on the hollow plug 62.

An annular device 64 surrounds the pillar 61.

A protruded block 65 is disposed on the pillar 61. The protruded block 65 is inserted in the internal recess 66 of the hollow plug 62.

The hollow plug 62 engages with the transverse pipe 42 until the positioning block 67 is inserted in the L-shaped end notch 46.

The pillar 61 is inserted through the hollow plug 62 and inserted in the through hole 44 of the transverse pipe 42.

Figure 8:
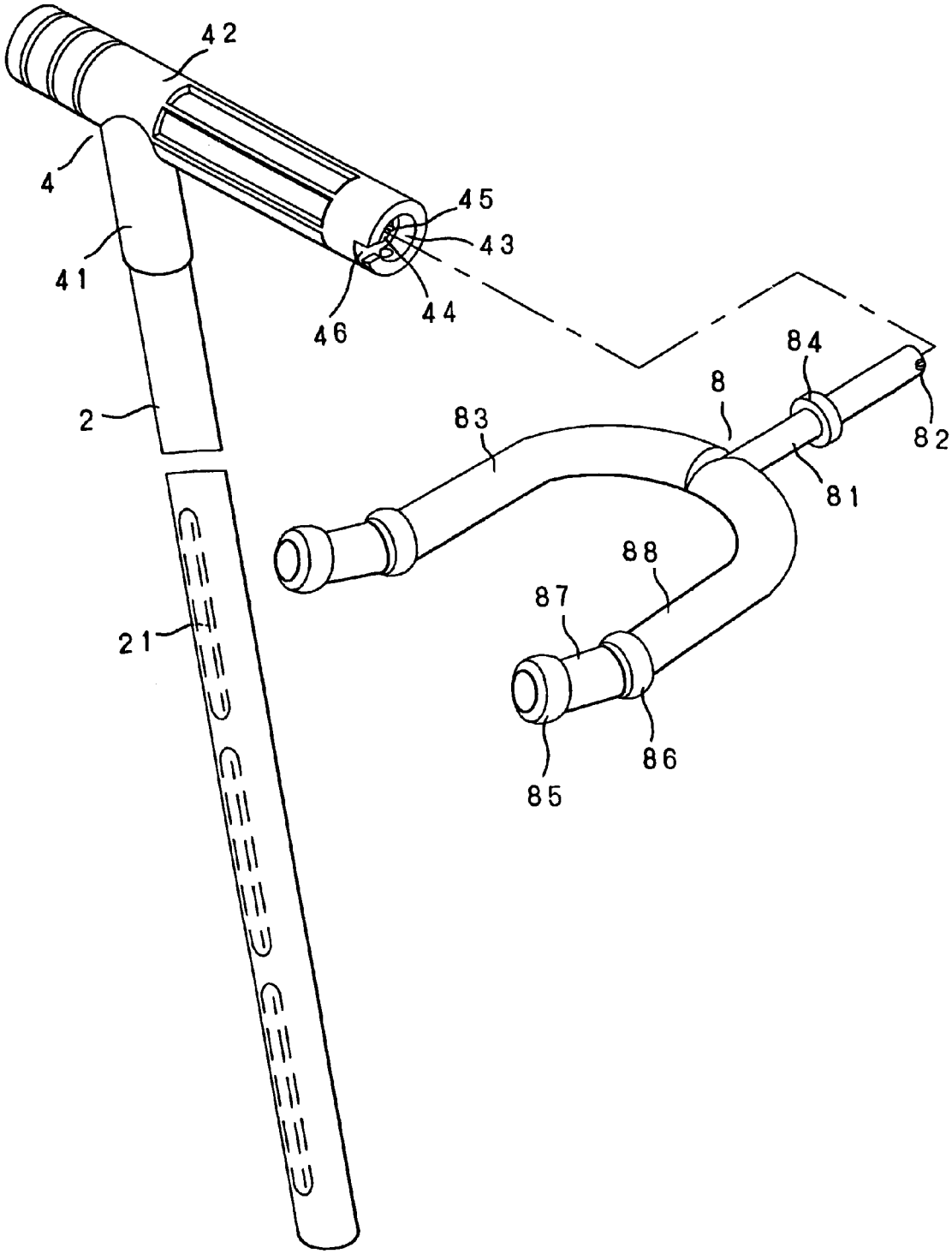
FIG. 8 is a perspective exploded view of a connector and a movable brace device of a preferred embodiment in accordance with the present invention.
Figure 10:
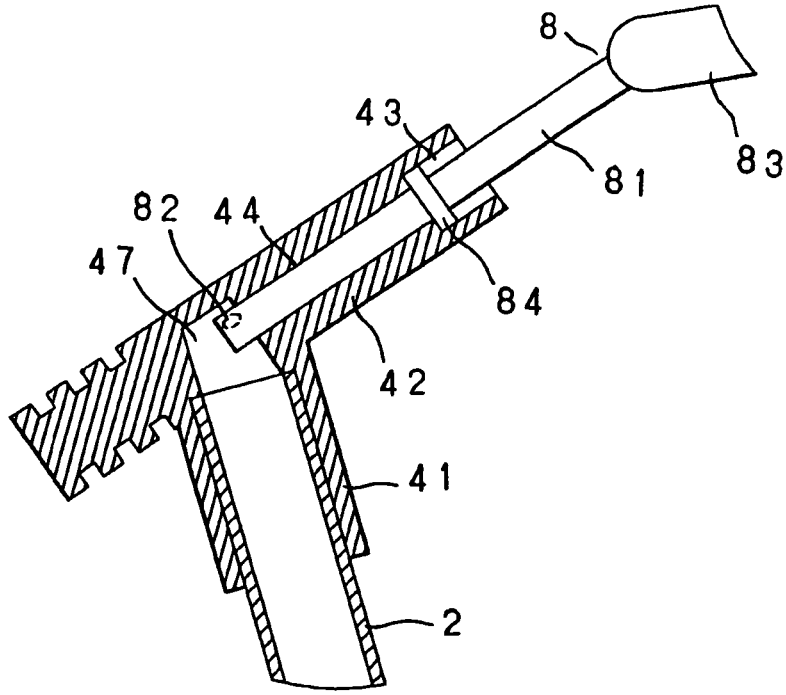
FIG. 10 is a sectional assembly view of a connector and a movable brace device of a preferred embodiment in accordance with the present invention.
Figure 11:
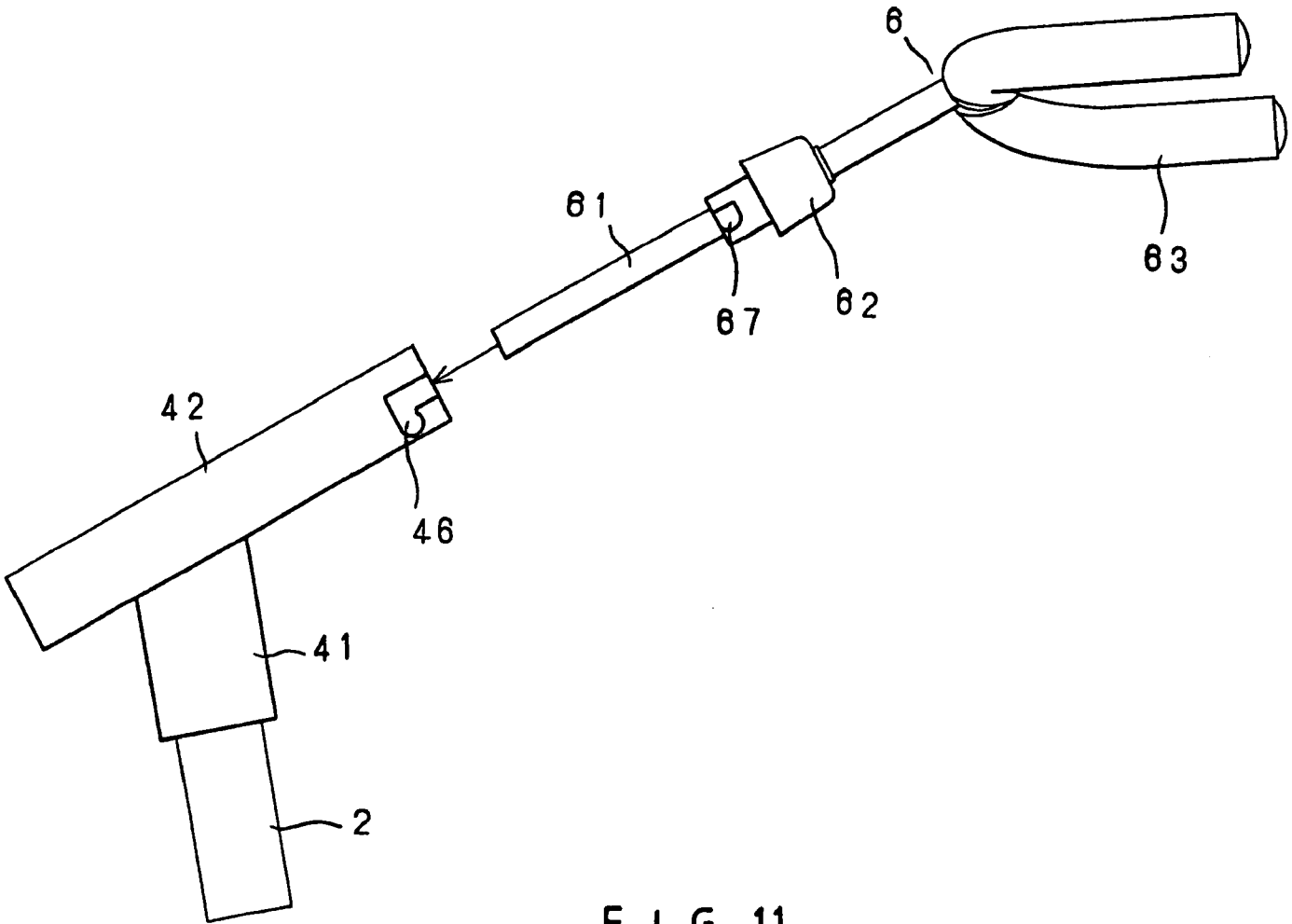
FIG. 11 is an elevational view of a connector and a fixed brace device of a preferred embodiment in accordance with the present invention.
Figure 12:
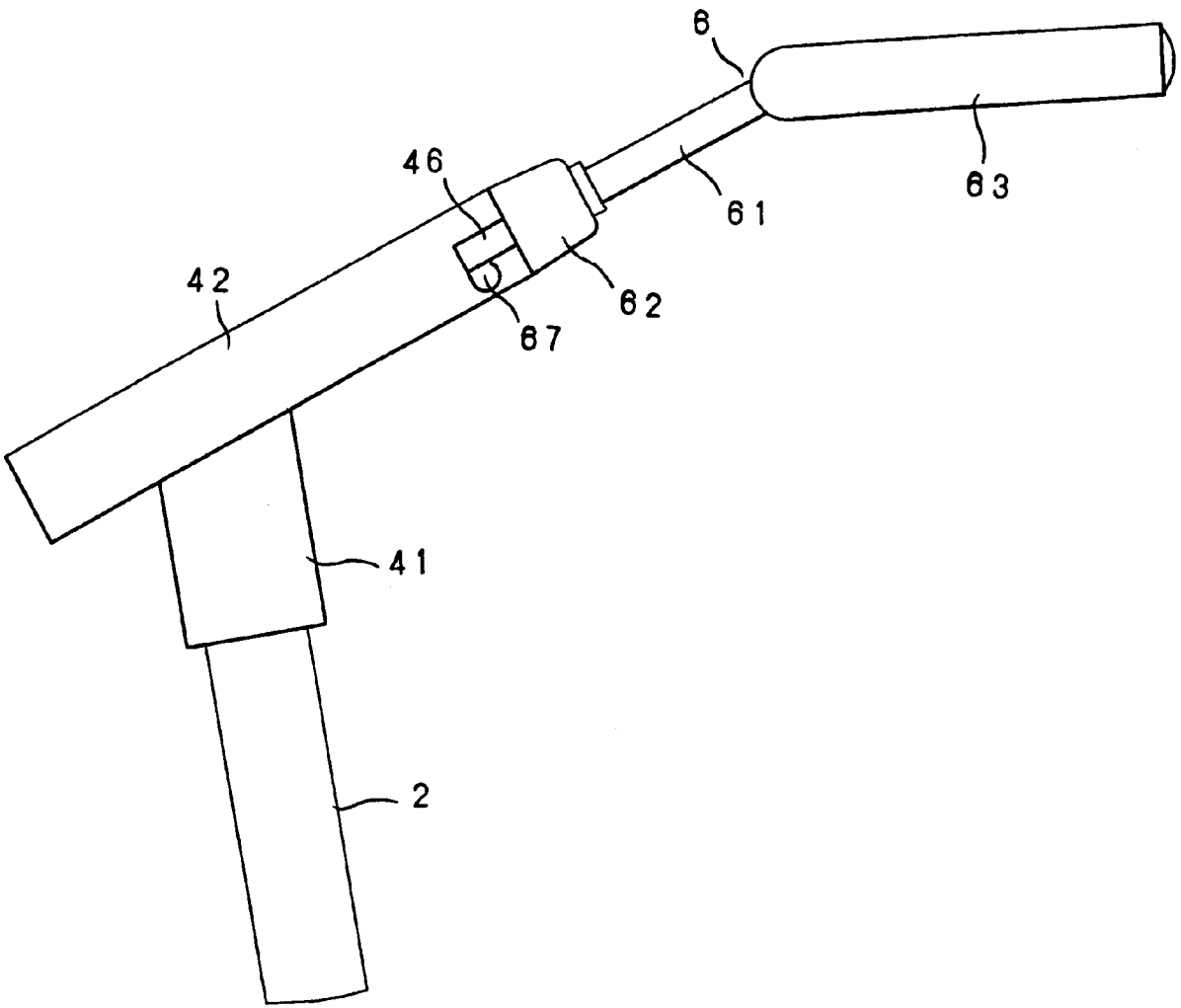
FIG. 12 is another elevational view of a connector and a fixed brace device of a preferred embodiment in accordance with the present invention.

Referring to FIGS. 8 and 10, a movable brace device 8 has a U-shaped tube 83, a column 81 connected to the U-shaped tube 83, the U-shaped tube 83 has two lateral bracing portions 88, and two arm tubes 87 each extending from the corresponding lateral bracing portion 88.

Each of the arm tubes 87 has an end annular flange 85.

Two annular flanges 86 each surrounds the corresponding arm tube 87.

The column 81 has an end protrusion 82.

A ring 84 surrounds the column 81.

The column 81 is inserted through the through hole 44 of the transverse pipe 42. The end protrusion 82 is moved along the inner recess 45 of the transverse pipe 42. After the end protrusion 82 passes through the inner recess 45 of the transverse pipe 42, the column 81 will rotate so that a wall of the inner chamber 47 blocks the end protrusion 82.

The ring 84 blocks the transverse pipe 42.

Figure 13:
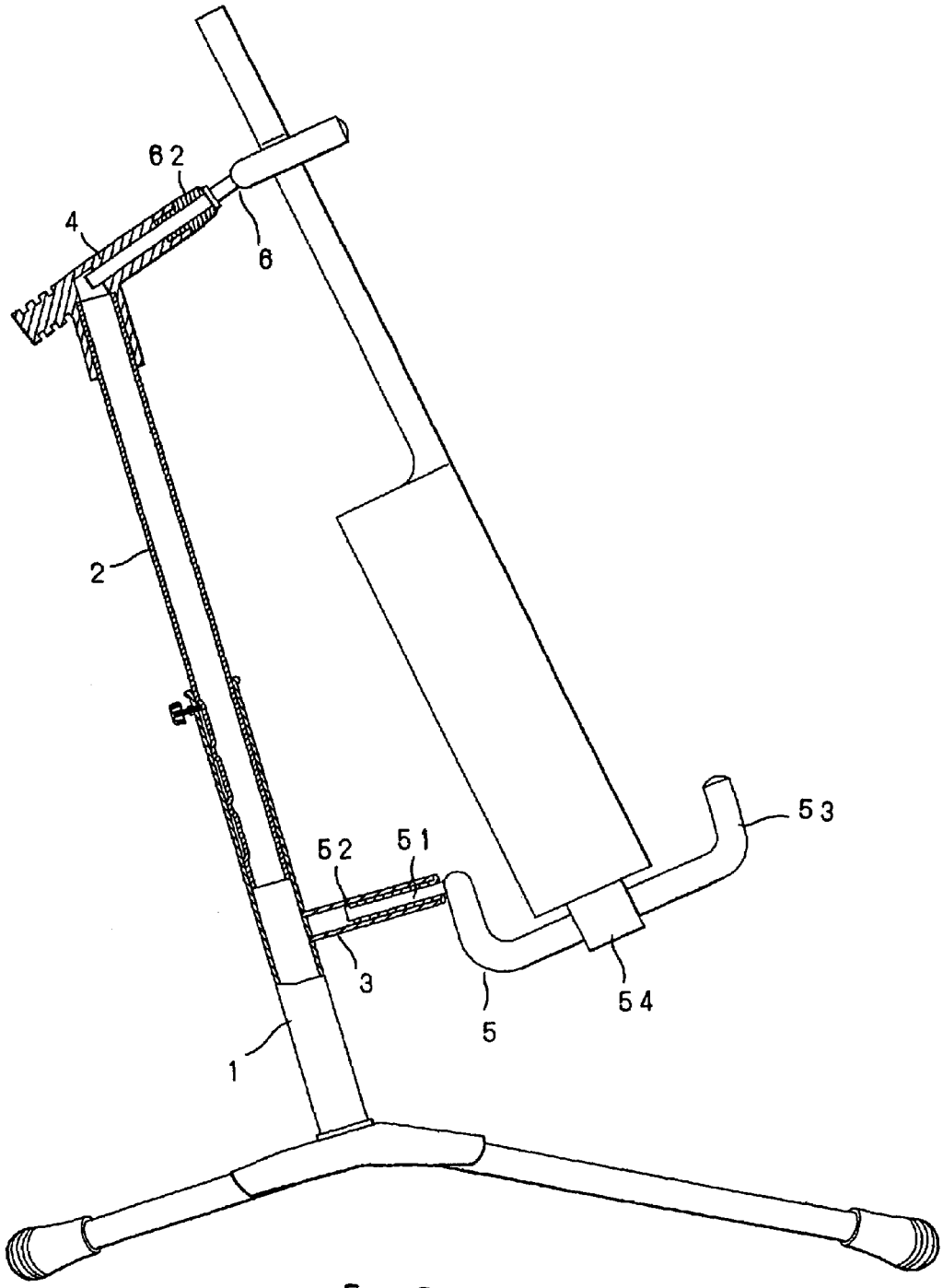
FIG. 13 is a schematic view illustrating a fixed brace device and a bracket support device holding a guitar.

Referring to FIG. 13, the fixed brace device 6 and the bracket support device 5 hold a guitar.

Figure 14:
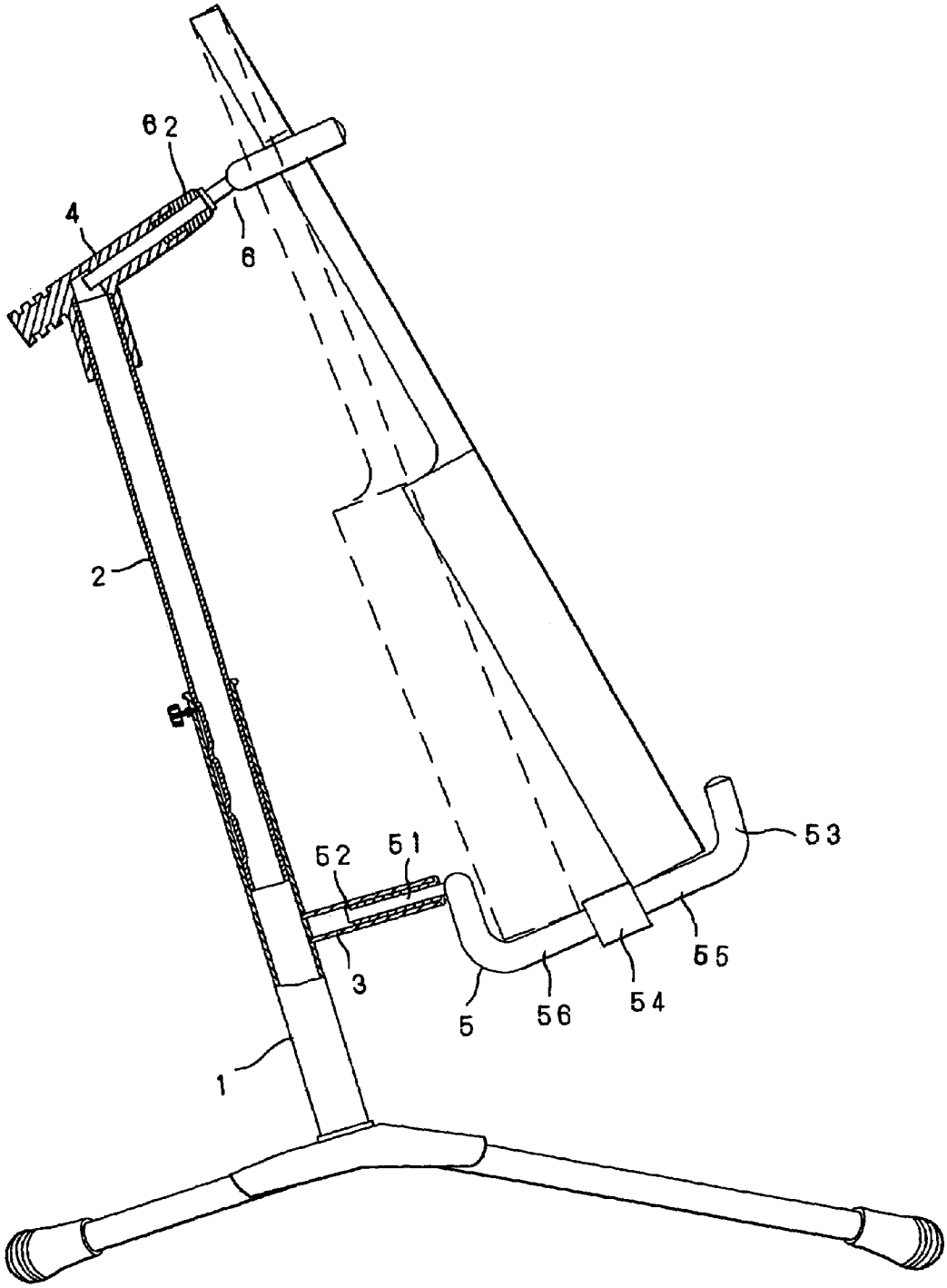
FIG. 14 is a schematic view illustrating a fixed brace device and a bracket support device holding an electric guitar.

Referring to FIG. 14, the fixed brace device 6 and the bracket support device 5 hold an electric guitar.

Figure 15:
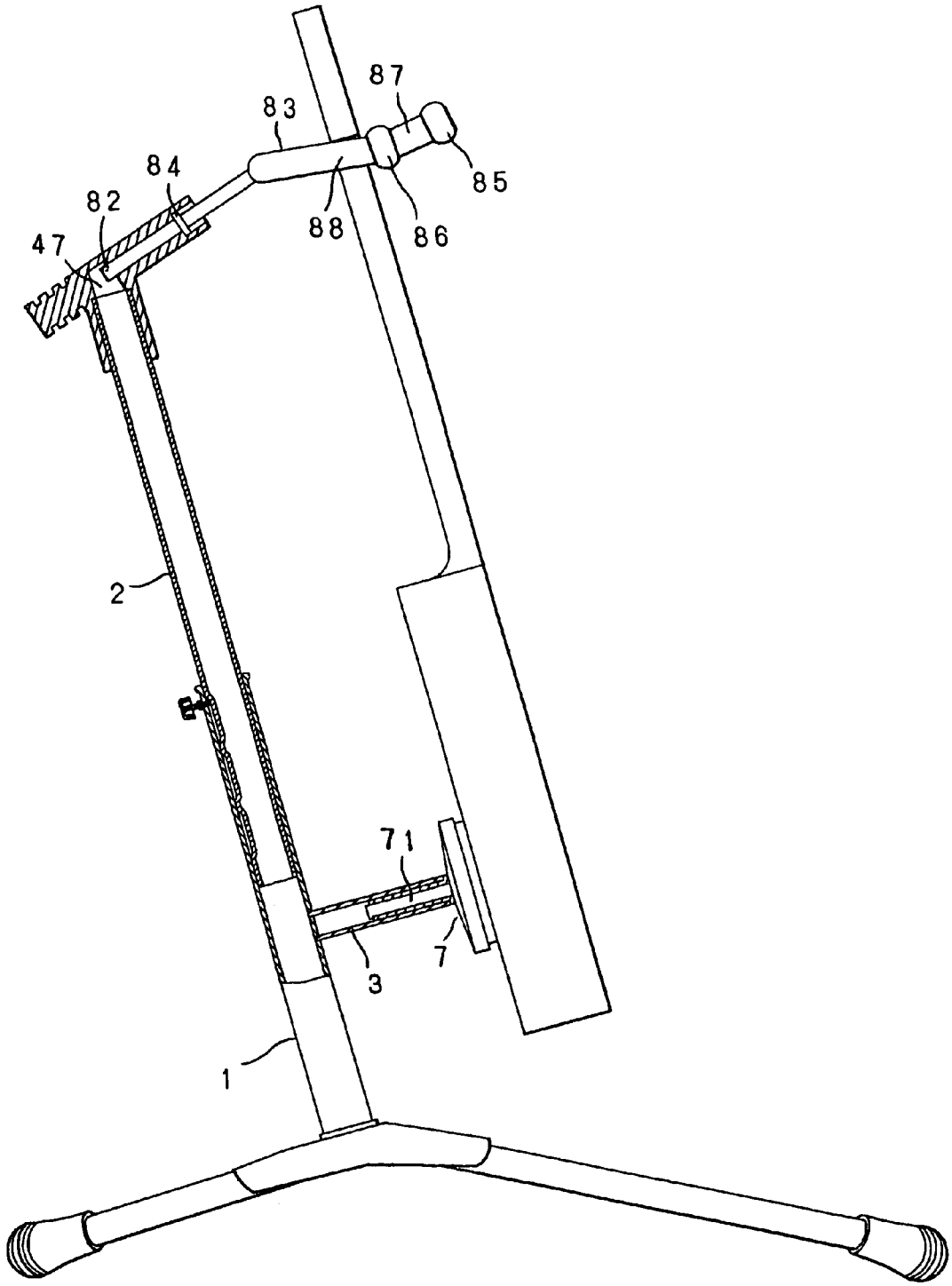
FIG. 15 is a schematic view illustrating a movable brace device and a padding support device holding a guitar.
Figure 16:
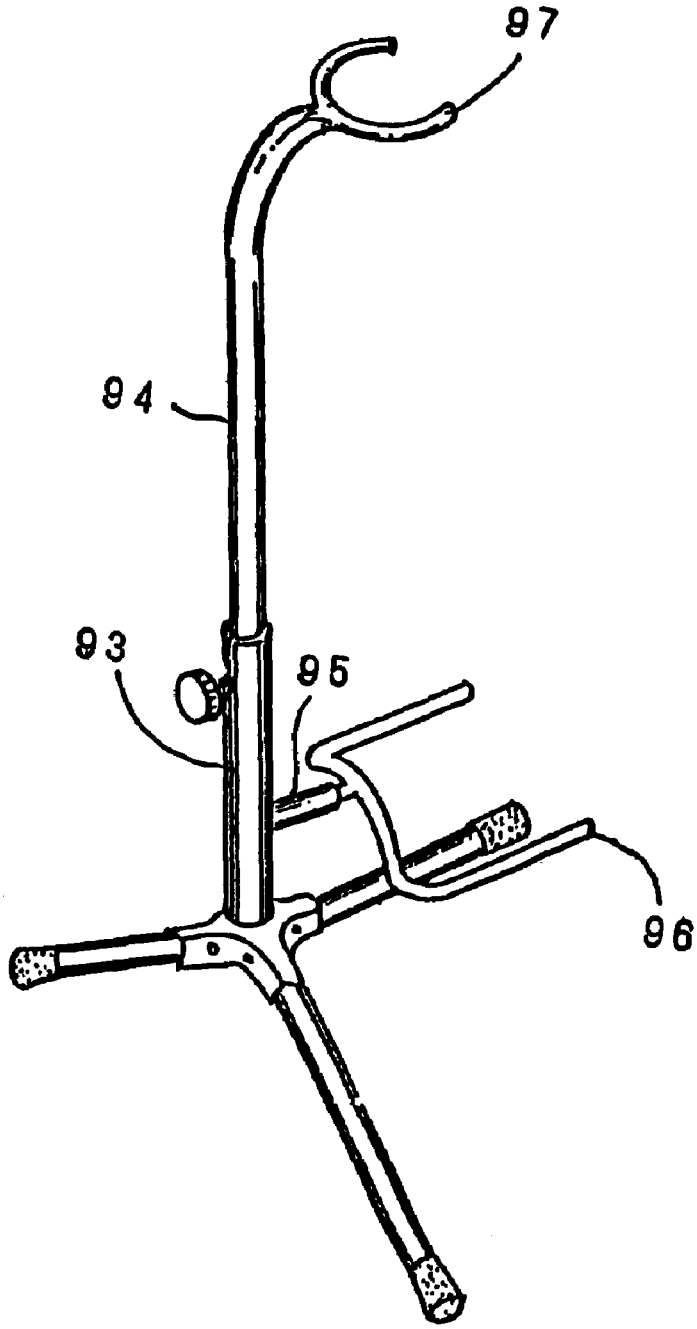
F I G. 16 PRIOR ART
FIG. 16 is a perspective assembly view of a conventional guitar stand of the prior art.

Referring to FIG. 15, the movable brace device 8 and the padding support device 7 hold a guitar.

The present invention has the following advantages.

One of the oblong grooves 21 of the main tube 2 receives the fastening bolt 16, so the main tube 2 will not fall off suddenly while the fastening bolt 16 is loosened.

The positioning block 67 is inserted in the L-shaped end notch 46 so that the hollow plug 62 will be engaged with the transverse pipe 42 stably.

The user will assemble the musical instrument stand of the present invention easily.

The user will detach parts of the musical instrument stand of the present invention easily.

The musical instrument stand of the present invention will hold one of various musical instruments stably.

The user has some choices to use the musical instrument stand of the present invention.

The first padding support device 7 has an oblong pad 72. If the user likes a round pad to replace the oblong pad 72, the second padding support device 7' which has a round pad 72' is a good choice.

If the user does not need a fixed support device, the movable bracket support device 5 will be a good choice.

The fixed brace device 6 will hold a head portion of a musical instrument stably.

If the user does not need the fixed brace device 6, the movable brace support device 8 will be a good choice.

Since the musical instrument stand of the present invention has many advantages, it is easy to satisfy various requirements of the user.

The present invention is not limited to the above embodiment but various modification thereof may be made. Furthermore, various changes in form and detail may be made without departing from the scope of the present invention.

What is claimed is:

1. A musical instrument stand comprising:

a base frame, a main tube, a socket, and a connector, the base frame having a joint, a first leg rod, a second leg rod, a third leg rod, a main pipe, and the joint connected to the first leg rod, the second leg rod, the third leg rod, and the main pipe, the main tube engaging with the main pipe, the main tube having a plurality of oblong grooves to receive a fastening bolt, the socket disposed on the main pipe, the connector disposed on a top end of the main tube, an inner tube inserted in the socket, the inner tube having an inner groove, a support device engaging with the socket, a brace device engaging with the connector, and the fastening bolt fastening the main pipe and the main tube, wherein the support device has a generally U-shaped rod, a shaft connected to the generally U-shaped rod, the shaft having an end block, two extending arm portions extending from two sides of the generally U-shaped rod, each of the extending arm portions having an end hook, and two pad collars each surrounding the corresponding extending arm portion, the shaft is inserted through the inner tube, and the end block is moved along the inner groove of the inner tube.

2. A musical instrument stand comprising:

a base frame, a main tube, a socket, and a connector, the base frame having a joint, a first leg rod, a second leg rod, a third leg rod, a main pipe, and the joint connected to the first leg rod, the second leg rod, the third leg rod, and the main pipe, the main tube engaging with the main pipe, the main tube having a plurality of oblong grooves to receive a fastening bolt, the socket disposed on the main pipe, the connector disposed on a top end of the main tube, an inner tube inserted in the socket, the inner tube having an inner groove, a support device engaging with the socket, a brace device engaging with the connector, the fastening bolt fastening the main pipe and the main tube, wherein the support device has a pad and a post connected to the pad, the post has a distal block and a positioning protrusion, the post in inserted through the inner tube, and the distal block is moved along the inner groove of the inner tube.

3. A musical instrument stand comprising:

a base frame, a main tube, a socket, and a connector, the base frame having a joint, a first leg rod, a second leg rod, a third leg rod, a main pipe, and the joint connected to the first leg rod, the second leg rod, the third leg rod, and the main pipe, the main tube engaging with the main pipe, the main tube having a plurality of oblong grooves to receive a fastening bolt, the socket disposed on the main pipe, the connector disposed on a top end of the main tube, an inner tube inserted in the socket, the inner tube having an inner groove, a support device engaging with the socket, a brace device engaging with the connector, the fastening bolt fastening the main pipe and the main tube, wherein the connector has a lower tube and a transverse pipe connected to the lower tube, the lower tube engages with the main tube, and the transverse pipe has an enlarged opening, an L-shaped end notch communicating with the enlarged opening, a through hole communicating with the enlarged opening, an inner recess formed in an inner wall of the transverse pipe, and an inner chamber communicating with the inner recess and the through hole.

4. The musical instrument stand as claimed in claim 3, wherein the brace device has a U-shaped tube, a pillar connected to the U-shaped tube, and a hollow plug to receive the pillar, the hollow plug has an internal recess, a positioning block is disposed on the hollow plug, an annular device surrounds the pillar, a protruded block is disposed on the pillar, the protruded block is inserted in the internal recess of the hollow plug, the hollow plug engages with the transverse pipe until the positioning block is inserted in the L-shaped end notch, and the pillar is inserted through the hollow plug and inserted in the through hole of the transverse pipe.

5. The musical instrument stand as claimed in claim 3, wherein the brace device has a U-shaped tube, a column connected to the U-shaped tube, the U-shaped tube has two lateral bracing portions, and two arm tubes each extending from the corresponding lateral bracing portion, each of the arm tubes has an end annular flange, two annular flanges each surrounds the corresponding arm tube, the column has an end protrusion, a ring surrounds the column, the column is inserted through the through hole of the transverse pipe, and the ring blocks the transverse pipe.

* * * * *